United States Patent [19]

Olson

[11] 4,044,919

[45] Aug. 30, 1977

[54] THERMOPLASTIC BAG DISPENSING ASSEMBLY

[75] Inventor: Robert H. Olson, Pittsford, N.Y.

[73] Assignee: Mobil Oil Corporation, New York, N.Y.

[21] Appl. No.: 609,269

[22] Filed: Sept. 2, 1975

Related U.S. Application Data

[63] Continuation-in-part of Ser. No. 552,076, Feb. 24, 1975, abandoned.

[51] Int. Cl.[2] ..... B65D 85/67

[52] U.S. Cl. ..... 221/63; 229/53

[58] Field of Search ..... 221/63; 206/526, 801; 229/53, 62, DIG. 13

[56] References Cited

U.S. PATENT DOCUMENTS

| | | | |
|---|---|---|---|
| 3,283,992 | 11/1966 | Hanson et al. | 229/53 |
| 3,395,830 | 8/1968 | Buttery | 221/63 |
| 3,760,940 | 9/1973 | Bustin | 206/58 |

*Primary Examiner*—Stanley H. Tollberg

*Attorney, Agent, or Firm*—Charles A. Huggett; James D. Tierney

[57] ABSTRACT

A carton and an asssembly of individual bags packaged therein. The carton is provided with an elongated slot which is located along an upper edge of the carton whereby individual bags may be dispensed from the carton one at a time. The bags are so arranged within the carton and the carton slot is so positioned that, upon withdrawal of each bag, the closure flap adjacent the bag mouth will be withdrawn first from the carton, making the open-bag mouth initially accessible for product insertion.

4 Claims, 12 Drawing Figures

FIG. 3A
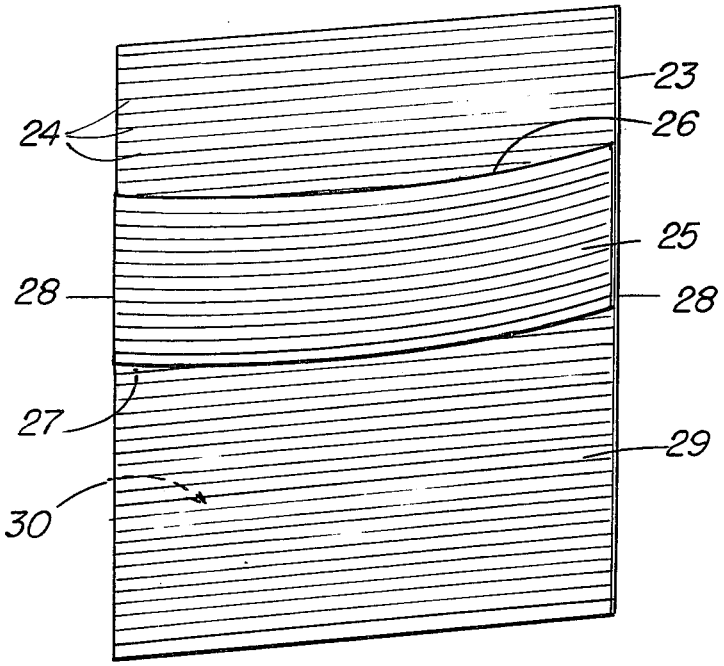
FIG. 4
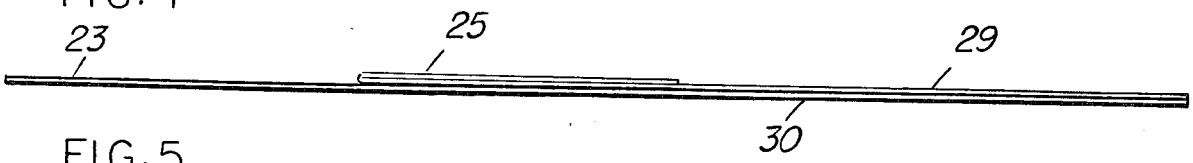
FIG. 5
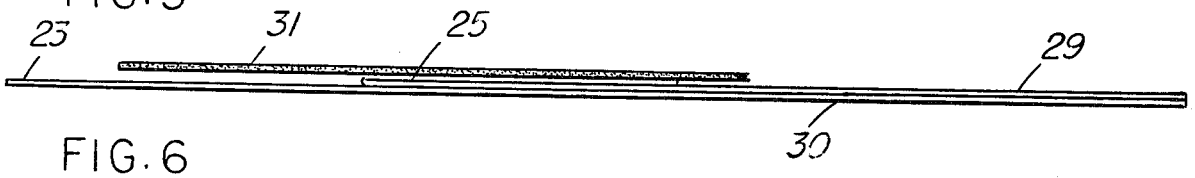
FIG. 6
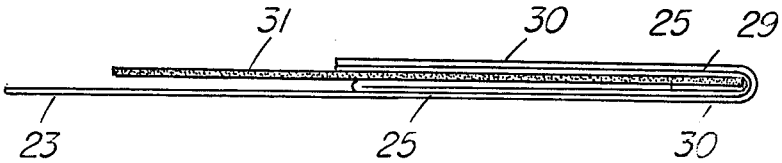
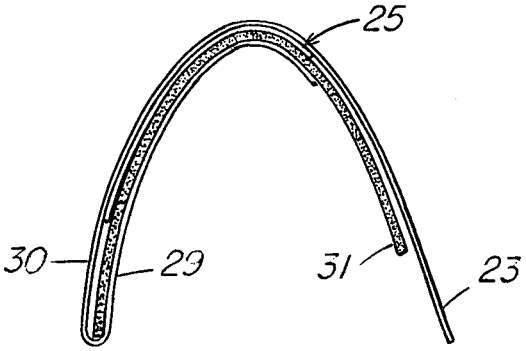
FIG. 7

THERMOPLASTIC BAG DISPENSING ASSEMBLY

CROSS-REFERENCE TO RELATED APPLICATIONS

The present application is a Continuation-In-Part application of U.S. application Ser. No. 552,076 filed Feb. 24, 1975, now abandoned.

BACKGROUND OF THE INVENTION

1. Field of the Invention

The present invention provides a dispensing carton for a thermoplastic bag whereby individual bags may be manually dispensed from a support insert positioned inside the dispensing carton. The bags are so arranged as to insure that the portion of the bag initially withdrawn from the carton will be the bag mouth. The bags are characterized by having transversely extending ribs on the bag walls thereby facilitating ease of grasping individual bags and insuring removal of the single bag at a time.

2. Description of the Prior Art

In the past, thermoplastic bags have been packaged utilizing a wide variety of packaging techniques. In certain instances, continuous rolls of bags have been packaged in individual dispenser cartons. Lines of weakness, e.g. perforations, separating each bag on such a roll allowed for individual bags to be torn from the roll as needed. In some cases individual bags have been folded and simply stacked in containers having a dispensing orifice for the removal of individual bags, however it was quite likely that more than the desired single bag would be extracted when attempts were made to remove a single bag. Other attempts which have been made in the prior art in the area of packaging individual thermoplastic bags include such prior art patents as U.S. Pat. No. 3,395,830 wherein it is shown that individual bags may be dispensed through a carton opening. The individual bags contained in the carton are positioned on an insert member. However, such prior art bag arrangements are not adapted for the dispensing of individual bags in a manner that the bag mouth is initially removed from the orifice. Moreover, it is extremely difficult to dispense individual bags from such an arrangement in view of the very slippery surface characteristics of the extremely thin thermoplastic film which has been used to fabricate such bags.

SUMMARY OF THE INVENTION

The present invention provides a thermoplastic bag dispensing assembly which comprises a dispensing carton and an assembly of bags disposed in a prearranged fashion about a resilient insert and positioned within the confines of the dispensing carton. The individual bags are characterized by having a plurality of spaced-apart, generally parallel ribs which extend transversely across the bag throughout its entire extent. The bags are positioned, i.e. folded about the resilient insert in such a manner that when a single bag is withdrawn through an orifice in the dispenser carton, the bag will always be oriented with its open mouth end emerging first from the orifice so as to facilitate rapid loading of product into the bag.

BRIEF DESCRIPTION OF THE DRAWINGS

FIG. 3A is a perspective view of one form of thermoplastic bag adapted for use in the container assembly of the present invention.

FIG. 4 is a side elevational view of the bag structure illustrated in FIG. 3A.

FIGS. 5, 6 and 7 illustrate the bag structure of FIG. 4 as it is sequentially folded around the cardboard insert, a single bag structure being shown rather than a plurality of bags for purposes of clarity of illustration.

DESCRIPTION OF SPECIFIC EMBODIMENTS

In accordance with one embodiment of the present invention, a carton is provided which may be filled with bags after it has been partly formed. Thermoplastic bags which are to be dispensed from the carton are folded around an insert member such as cardboard or other suitable sheet materials which exhibit some degree of resiliency. The dimensions of the insert member is designed so that the member must be bowed into an arcuate or curved form for its insertion into the carton. In preparation for loading the carton, a desired number of plastic bags are folded around one edge of the insert. The assembly, i.e. insert and bags folded around one edge thereof, is then folded upon itself and subsequently inserted into the partially formed carton. In a specific embodiment of the present invention, the assembly may be inserted through the bottom of a partially preassembled carton and carton bottom flaps subsequently glued together thereby completing the carton construction with the bag and insert member assembly contained within the confines of the carton.

Figure 1:
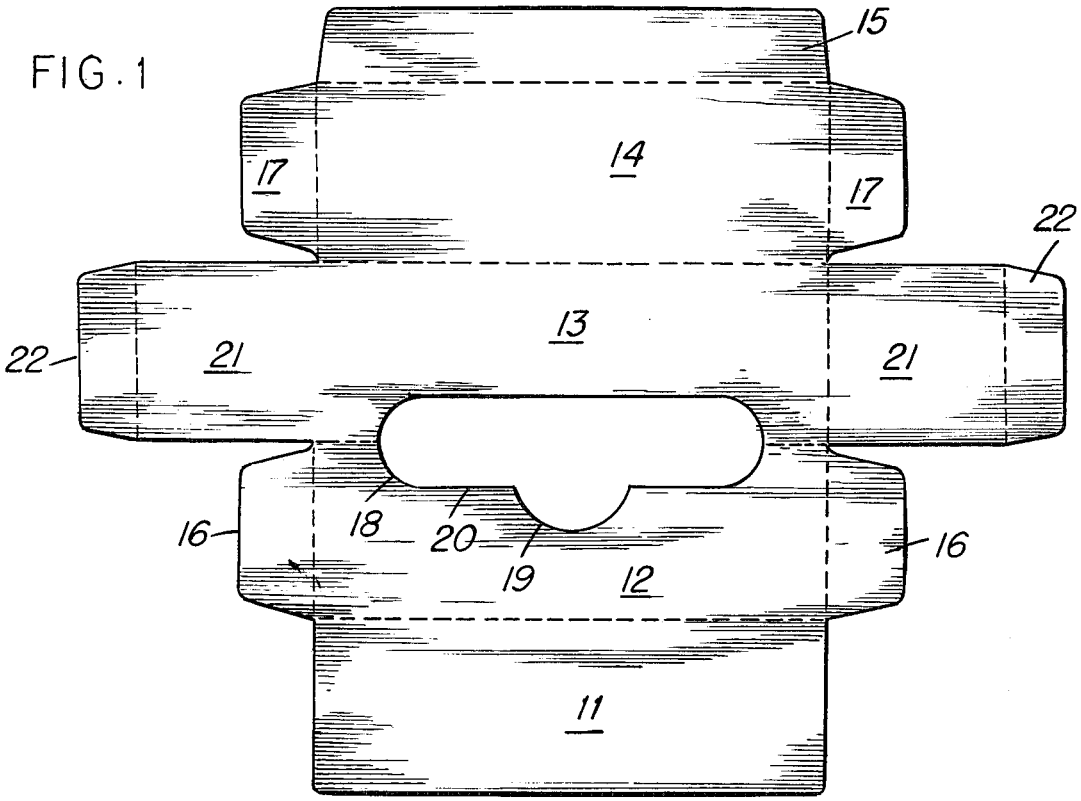
FIG. 1 is a plan view of a blank cut and scored to provide a dispensing carton according to one embodiment of the present invention.

One embodiment of the carton which may be employed in the assembly structure of the present invention is formed from an integral blank as shown in FIG. 1. Such a carton comprises a side wall 14 and a side wall flap 15. Side wall 14 is connected to carton top wall 13, top wall 13 having hinged along opposite edges thereof end wall flaps 21 and end wall locking tabs 22 being hinged to the end wall flaps 21 along opposite edges thereof. Top wall 13 has hinged along a longitudinal edge thereof side wall 12 to which is hinged bottom wall 11. End closure flaps 16 and 17 are hinged along opposite edges of side walls 14 and 12. It will be noted that the carton front wall and top wall are provided with spaced apart perforations or fracture scores 18 which extend intermediate walls 13 and 12. The perforated pattern is characterized by having a protruding notch 19 along one edge thereof. Removal of this perforated section after the carton construction is completed and the bags are positioned therein provides easy access to the bag contents for the sequential removal of individual bags.

In erecting the carton, the flat carton blank as typified by FIG. I is placed face down. The end flaps 16 and 17 are folded upward and spots of adhesive applied to their outer surfaces. A forming foot then pushes the top panel 13 downward into a receptacle sized to the outside dimensions of the carton. During this operation, the end flaps 21 are faced inward to contact the adhesive on sidewall flaps 16 and 17. The carton is now ejected and is ready for loading with bags.

The bag structures which may be employed in the dispensing assembly of the present invention may constitute any size, shape and form of thermoplastic bags fabricated from polyethylene, polypropylene and other polyolefins, polyester, polyvinylchloride and blends and copolymers thereof. For purposes of illustration a specific type of bag construction which may be used in the dispenser assembly of the present invention is illustrated in FIG. 3A. As shown in FIG. 3A, such a bag structure comprises a single-layer flap 23, an extension of bag back wall 30, which is adapted to be folded downwardly and around the top portion of the product, e.g., a sandwich, which is positioned within the bag pouch 29. Adjacent the open mouth 26 of bag pouch 29 there is positioned a closure flap 25. Closure flap 25 may be considered an extension of the front wall of pouch 29 which has been folded back and sealed along its edges at 28 to firmly anchor the side edges of closure flap 25 to the side edges of the bag. Bags of this type are quite common and are generally referred to as "fold and lock" type bags. When such a bag is employed to package an article, the article is inserted into the open mouth 26 of the bag and down into pouch 29. Subsequently, flap 23 is folded downwardly into pouch 29 and over the upper portion of the article in pouch 29, flap 23 extending part way into pouch 29. The open mouth 26 of the bag is subsequently locked in a closed position by grasping locking flap 25 at each of its opposite edges and turning flap 25 inside out whereby the flap then will extend across open mouth 26 and down the upper portion of back wall 30 of the bag thereby positively securing the contents of the bag inside pouch 29. It will be noted that the bag structure illustrated in FIG. 3A is characterized by having a plurality of transversely extending ribs 24. These ribs are an integral part of the material of construction of the bag, e.g. polyethylene. The ribs may be formed in the thermoplastic sheet material during the extrusion process employed in fabricating such sheet material. A variety of techniques may be employed for the production of such ribs including the method disclosed in U.S. Pat. No. 2,750,631, the disclosure of which is incorporated herein by reference. As hereinbefore noted, applicant has found that the presence of such transverse ribs on the individual bag structures, in addition to increasing the tensile modulus, i.e. stiffness, of the otherwise relatively limp, thin thermoplastic use to construct the bags, ribs 24 more importantly facilitate the sequential removal of individual bags from the dispensing carton in singular fashion, since the ribs provide for a more positive gripping action when a bag is being dispensed and therefor tend to minimize or eliminate the possibility of a plurality of bags being removed when only a single bag is desired.

The ribbed thermoplastic bag structure itself is best seen in FIG. 3A. The thermoplastic web from which the bag was fabricated (utilizing conventional heat sealing techniques) was produced utilizing a conventional prior art extrusion apparatus having a tubular die thereon which was modified to produce the ribs 24 in the extruded thermoplastic material (see for example the above-referred to U.S. Pat. No. 2,750,631), and expanded by an enclosed air bubble. The thermoplastic webbing produced by such a process is characterized by having ribs 24 projecting from both surfaces of the film material. The individual ribs 24, are peaked and have sloping sides which merge smoothly with the flat thermoplastic web material between ribs 24. In a preferred form, the dimensions for the thickness in the film between ribs 24, that is the nominal thickness, may be from about 0.01 mm to 0.05 mm, preferably about 0.02 mm (0.7 mils). The overall thickness of the ribs 24 is about 0.09 mm (3.5 mils). The spacing from peak to peak of ribs 24 may vary within wide limits, for example from about ¼ cm to 2 cm, a range closer to the lower end being preferred, for example about ½ to 1 cm. The lateral extent of the thickening formed by the ribs which determine the slope of the ribs as they merge smoothly into the flat thermoplastic material intermediate the ribs should be so selected that the merger is gradual, to provide a defined peak rib, with smooth transition to the web intermediate the rib areas. This dimension for a rib thickness of 0.09 mm and a web thickness of about 0.07 mm would be about 0.6 mm (25 mils) a thermoplastic web or bag of such dimensions will have the same mass (weight) as a smooth web having an average wall thickness of about 0.025 mm (1.0 mils) and the overall extent of the thickness of the ribs 24 should be in the order of about 1.5 to 4 times the wall thickness of the film intermediate the ribs. The widths of the rib throughout the region where the film is thickened should be about 4 to 10 times the thickness of the ribs 24. These ranges are given as preferred dimensions, in which the advantages of the ribs are best obtained when the material is formed into a bag as shown in FIG. 3A. For a specific embodiment of the dimensions of the ribbed material employed to form the bag structure shown in FIG. 3A, ribs 24 which extend transversely across the bag structure are spaced on ¼ inch centers and have a total height or thickness of about 3.5 mils. The thickness of the film intermediate adjacent ribs 24 is about 0.7 mil. As hereinbefore noted, when such ribs are formed into the bag structures employed in the dispenser assembly of the present invention, the transverse ribs allow for a positive gripping action to insure that only a single bag, i.e. only the outermost bag in the stack of bags is grasped by the user when withdrawing an individual bag through a dispensing orifice. This is in contrast with prior art smooth surfaced, slippery thermoplastic bags whereby an undesirable plurality of bags would be removed in a single withdrawal operation by virtue of the bags adjacent the dispensing orifice blocking or clinging together. Such tendency for the bags to block or cling together is eliminated or quite substantially reduced utilizing the ribbed bag structures of the present invention.

Additionally, the ribs which have a stiffening effect on the bag structure promote ease of handling of the bag including bag opening and ease of product insertion into the bag. This is in marked contrast to bags of equivalent thickness but having no rib structure which are extremely flimsy and limp making handling thereof quite difficult.

In FIG. 4 there is shown a side elevational view of the bag structure illustrated in FIG. 3A. It will be noted that the bag comprises a flap 23, a closure flap 25, an article retaining pouch 29 and a pouch back wall 30 as hereinbefore discussed. FIGS. 5, 6 and 7 illustrate the sequence of operation for folding and positioning the bag about insert member 31. It will be understood that such an operation will always be done with a plurality of bag being folded around cardboard insert 31, however for the sake of clarity of illustration this operation has been shown in FIGS. 5, 6 and 7 utilizing a single bag.

As shown in FIG. 5 rectangular cardboard insert member 31 is initially positioned across the width of the bags and in contact with closure flap 25. All of the superimposed bags in a stack (not shown) will be oriented in an identical fashion. The insert member 31 may extend for approximately the full width of the bag or may be slightly shorter than the bag width. Insert 31 is positioned so that it extends substantially entirely across locking flap 25 and is also superimposed across a substantial portion of end flap 23. As shown in FIG. 5, insert 31 only slightly projects on to the bag pouch portion 29. After insert 31 has been positioned atop a stack of bags as illustrated in FIG. 5, the bag pouch portions 29 are folded up and over the top of insert 31 as shown in FIG. 6. Finally, as illustrated in FIG. 7, the entire assembly of FIG. 6 is folded over upon itself causing insert 31 to bow, whereby it assumes U-shaped configuration.

Figure 1A:
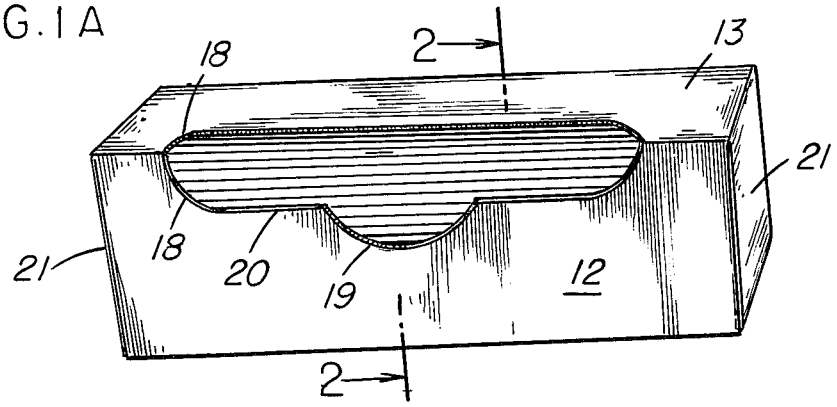
FIG. 1A is a schematic perspective view of a carton formed from the blank of FIG. 1 in an assembled and erect position.

The insert 31 bag-assembly shown in FIG. 7 is subsequently positioned in the carton structure illustrated in FIG. 1A, which carton has been formed from the cut and scored blank illustrated in FIG. 1. A convenient method for inserting the bag assembly into the carton is through the carton bottom whereby carton bottom wall 14 and flap 15 are left in an open and unglued position until the insert-bag assembly is positioned within the confines of the carton whereupon carton bottom wall 14 is glued in a closed position.

Figure 2:
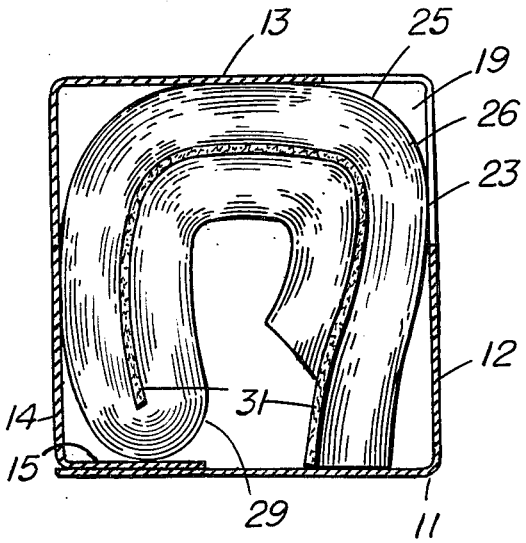
FIG. 2 is a cross-sectional view taken at the line 2—2 of FIG. 1A showing the arrangement of the bag contents and insert element within the loaded carton.

The insert-bag assembly, when positioned in the carton, will assume a configuration and orientation as shown in FIG. 2. It will be noted that the bag support insert member 31 assumes an inverted U-shaped configuration with the legs of the U being positioned adjacent the carton bottom wall. That end of the bag stack, which comprises the superimposed bag pouches 29 is tucked around one leg of the U and positioned within the confines of the U-shaped insert legs. The superimposed flap ends 23 of the bag stack are located outside of the confines of the U-shaped insert 31 and a portion of flap 23 on the outer most bag in the assembly is positioned adjacent the carton dispensing orifice formed by the removal of tear strip 20 by tearing along the perforations 18 as illustrated in FIG. 1. The flaps 23 of successive bags are presented for removal at the dispensing orifice as each bag is removed from the dispensing orifice. The resilient properties of the bowed insert member 31 enable it to continue to present the flap 23 of the remaining bag at the dispensing orifice even after a substantial member of bags have been removed.

Figure 3:
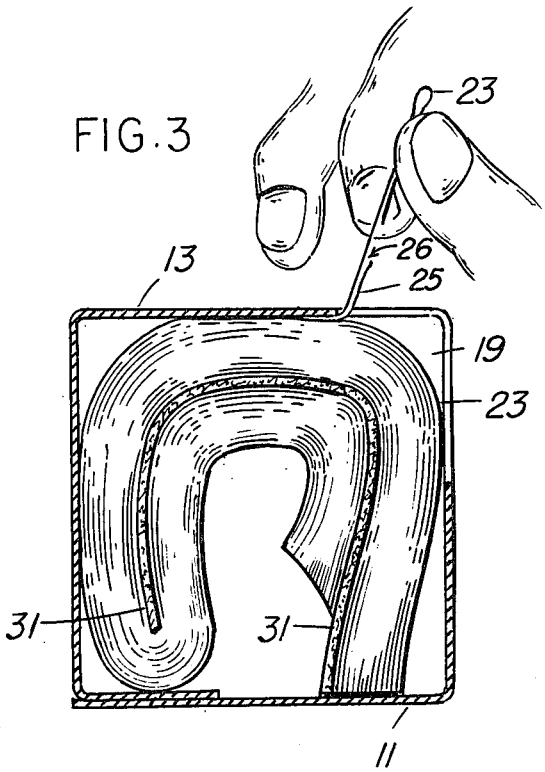
FIG. 3 is a view similar to FIG. 2 illustrating the initial step in the removal of an individual bag from the carton structure.

Accordingly, and as more clearly illustrated in FIG. 3, when it is desired to dispense an individual bag from the carton only flap 23 is accessible through the carton dispensing orifice whereby flap 23 is initially withdrawn from the carton which results in the bag mouth portion 26 emerging from the carton before pouch 29 whereby bag mouth 26 is immediately accessible for loading product into the bag structure thereby eliminating the necessity for repeated orientation of each bag when it is removed from the carton to locate the individual bag mouth areas.

Figure 8:
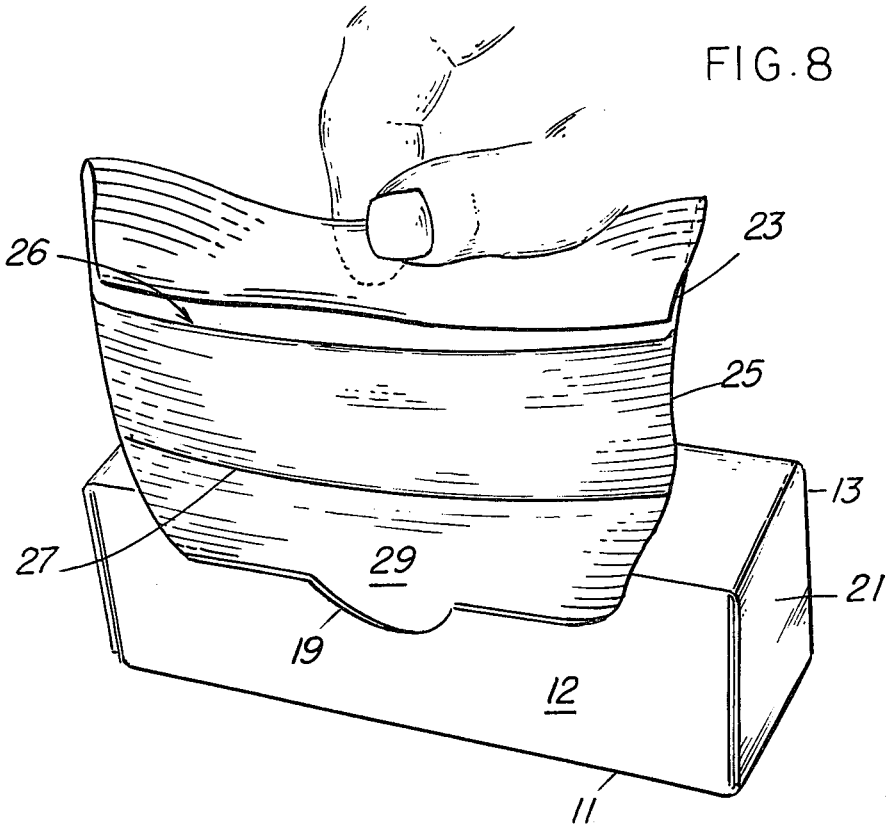
FIG. 8 is another perspective view of a single bag structure being withdrawn from a carton with the open mouth of the bag being immediately accessible for loading purposes.

As shown in FIG. 8, when an individual bag is removed from the carton assembly, flap 23 may be pinched for positive gripping action, by grasping a portion of flap 23 through thumb notch 19 and another portion of flap 23 is simultaneously grasped along the elongated portion of the dispensing aperture and the individual bag is subsequently withdrawn from the carton.

Figure 10:
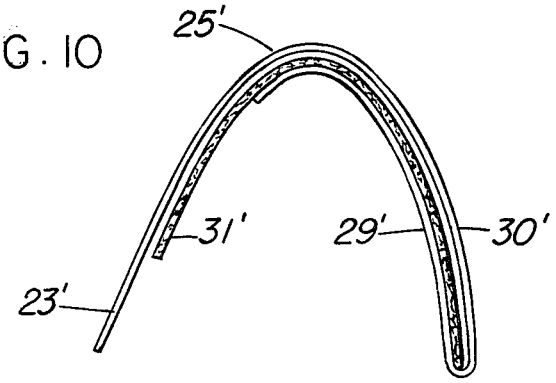
FIG. 10 illustrates the bag structure of FIG. 4 which has been folded around a cardboard insert in an alternate arrangement to that illustrated in FIG. 7, a single bag structure being shown rather than a plurality of bags for purposes of clarity of illustration.

FIG. 10 illustrates an alternate arrangement by which the bag structures of the present invention may be positioned around insert member 31'. It will be noted that the bag positioning arrangement shown in FIG. 10 is quite similar to that shown in FIG. 7. However, the bags in FIG. 10 are arranged so that flap 23' will now be positioned against back wall 14 of the carton and more remote from the carton dispensing orifice than the flaps 23 of FIG. 7. Such an arrangement insures that, in the event of bag-insert assembly displacement within the carton during transport or handling of the carton, no more than a single flap end 23' will be available for withdrawal from the carton thereby substantially eliminating the possibility of the accidental simultaneous withdrawal of a plurality of bags from the carton.

Figure 9:
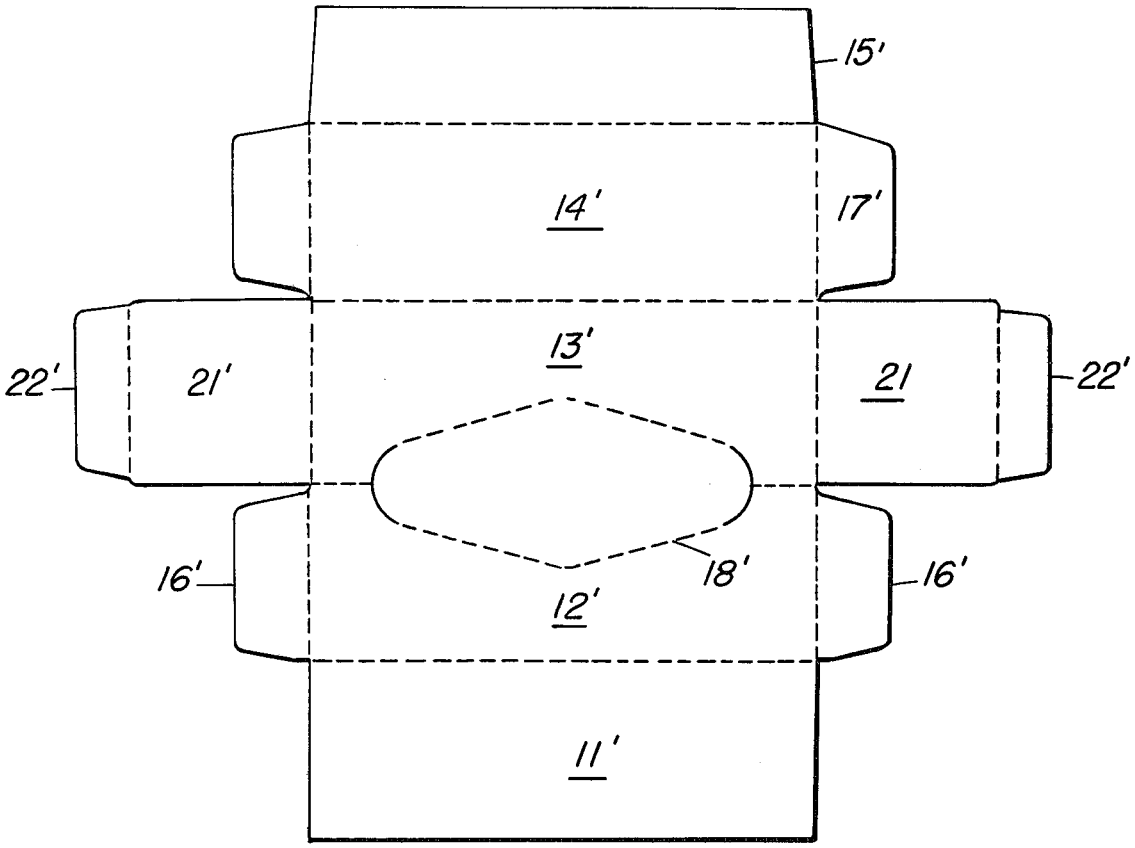
FIG. 9 is a plan view of an alternative form of carton blank which has been cut and scored to provide a dispensing carton according to another embodiment of the present invention.

Another embodiment of a carton, shown as a blank, which may be employed in the assembly structure of the present invention is illustrated in FIG. 9. The carton blank shown in FIG. 9 is identical to the structure illustrated in FIG. 1 and as hereinbefore described with the exception of the configuration of the bag dispensing orifice. As shown in FIG. 9 the dispensing orifice which extends into the carton top wall 13' and the carton front wall 12' is generally an elongated oval configuration with the minor axis slightly distended. Notch 19, as shown in FIG. 1 is eliminated. Such an orifice configuration has been found to permit ease of individual bag removal from the carton.

It is to be understood that the invention is not limited to the exact details of construction, operation, or exact materials or embodiments shown and described, as obvious modifications and equivalents will be apparent to one skilled in the art, and the invention is therefore to be limited only by the scope of the appended claims.

What is claimed is:

1. A thermoplastic bag dispenser assembly comprising a dispenser carton containing a plurality of thermoplastic bags mounted on and folded about a resilient insert member, said bags having an open mouth and a closed bottom said closed bottom portions being folded underneath said insert member and said open mouth portions resting on the upper surface of said insert member, said carton comprising coextensive bottom, top, front and rear walls and an end wall at each opposed end of the carton, said top and front walls having a longitudinally extending tear strip defined by a pattern of perforations which extend in an oval-like configuration around a common longitudinal edge of the carton top and front wall, said thermoplastic bags being characterized by having transversely extending, spaced-apart and substantially parallel ribs, said ribs being solid, continuous and formed as an integral part of said thermoplastic bag, and said bags being positioned on said resilient insert member so that, upon removal of said tear strip from said carton thereby forming a bag dispensing orifice, individual bags are dispensed from said carton with the open mouth of said bag in an upright position and ready for loading.

2. A thermoplastic bag dispenser assembly as defined in claim 1 wherein said bag comprises a pouch portion comprising a front wall and a rear wall integrally joined together along their bottom and longitudinal edges, an open mouth portion, a closure flap positioned on the exterior surface of the upper portion of said bag rear wall, the opposite longitudinal edges of said flap secured to the opposite longitudinal edges of said upper rear wall portion and an end flap which is an extension of said bag front wall.

3. A thermoplastic bag dispenser assembly comprising a dispenser carton having a plurality of thermoplastic bags mounted on and folded about a resilient insert member, said bags having an open mouth and a closed bottom, said closed bottom portions being folded underneath said insert member and said open mouth portions resting on the upper surface of said insert member, said carton comprising coextensive bottom, top, front and rear walls and an end wall at each opposed end of the carton, said carton having a longitudinally extending tear strip defined by a continuous pattern of perforations, said thermoplastic bags being characterized by having transversely extending spaced-apart and substantially parallel ribs, said ribs being solid, continuous and formed as an integral part of said plastic bag, and said bags being positioned on said resilient insert member so that, upon removal of said tear strip from said carton to form a bag dispenser orifice, individual bags are dispensed from said carton with the open mouth of said bags in an upright position and ready for loading.

4. A thermoplastic bag dispenser assembly in accordance with claim 1 wherein said pattern of perforations extend around a common longitudinal edge of said carton top and front wall forming a tear strip which when removed to form said bag dispenser orifice, said orifice extends around a common longitudinal edge of said carton top and front wall.

* * * * *